United States Patent [19]

Miller et al.

[11] Patent Number: 5,023,411

[45] Date of Patent: Jun. 11, 1991

[54] SENSING EDGESWITCH FOR A DOOR

[75] Inventors: Norman K. Miller; Bearge D. Miller, both of Concordville, Pa.

[73] Assignee: Miller Edge, Inc., Concordville, Pa.

[21] Appl. No.: 592,410

[22] Filed: Oct. 3, 1990

Related U.S. Application Data

[63] Continuation-in-part of Ser. No. 491,781, Mar. 12, 1990, Pat. No. 4,972,054, which is a continuation-in-part of Ser. No. 396,493, Aug. 21, 1989, Pat. No. 4,908,483, and a continuation-in-part of Ser. No. 384,348, Jul. 21, 1989, Pat. No. 4,954,673.

[51] Int. Cl.[5] ..... H01H 3/16

[52] U.S. Cl. ..... 200/61.43

[58] Field of Search ..... 200/61.43, 86 R

[56] References Cited

U.S. PATENT DOCUMENTS

| | | | |
|---|---|---|---|
| 3,133,167 | 5/1964 | Miller | 200/61.43 |
| 3,243,540 | 3/1966 | Miller | 200/86 R |
| 3,260,812 | 7/1966 | Miller | 200/61.43 |
| 3,315,050 | 4/1967 | Miller | 200/61.43 |
| 3,321,592 | 5/1967 | Miller | 200/61.43 |
| 3,986,577 | 10/1976 | Ebbesson et al. | 180/92 |
| 4,045,631 | 8/1977 | Dann | 200/61.43 |
| 4,051,336 | 9/1977 | Miller | 200/61.43 |
| 4,349,710 | 9/1982 | Miller | 200/61.43 |
| 4,396,814 | 8/1983 | Miller | 200/61.43 |
| 4,620,072 | 10/1986 | Miller | 200/81 R |
| 4,785,143 | 11/1988 | Miller | 200/61.43 |
| 4,908,483 | 3/1990 | Miller | 200/61.43 |
| 4,954,673 | 9/1990 | Miller | 200/61.43 |
| 4,972,054 | 11/1990 | Miller et al. | 200/61.43 |

*Primary Examiner*—J. R. Scott

*Attorney, Agent, or Firm*—Panitch Schwarze Jacobs & Nadel

[57] ABSTRACT

A redundant sensing edge for a door causes a closing door to open by actuating a device upon force being applied to the sensing edge. The sensing edge includes a flexible air-impervious elongate outer sheath which is compressible upon application of external pressure. A substantially sealed air-impervious first chamber is positioned within the elongate sheath. A pressure-sensitive switch is in fluid communication with the first chamber for sensing pressure change within the chamber, such that upon application of external pressure to the sheath, the pressure switch is actuated. A second chamber is positioned within the sheath proximate the first chamber. A switch is positioned within the second chamber and includes a first generally cylindrical layer of resiliently compressible material, a first generally cylindrical layer of electrically conductive material, a generally cylindrical layer of non-conductive material, a second generally cylindrical layer of electrically conductive material, a second generally cylindrical layer of resiliently compressible material and a generally cylindrical support member layered in the recited order. Upon application of external pressure to the sheath, a portion of at least one of the first and second layers of electrically conductive material deflects into an opening in the layer of non-conductive material and makes electrical contact between the first and second layers of electrically conductive material to thereby actuate the device.

10 Claims, 1 Drawing Sheet

SENSING EDGESWITCH FOR A DOOR

REFERENCE TO RELATED APPLICATIONS

This is a continuation-in-part of copending U.S. patent application Ser. No. 491,781, filed Mar. 12, 1990, now U.S. Pat. No. 4,972,054 which is a continuation-in-part of U.S. patent application Ser. No. 396,493, filed Aug. 21, 1989, now U.S. Pat. No. 4,908,483, issued Mar. 13, 1990 and copending U.S. patent application Ser. No. 384,348, filed Jul. 21, 1989, now U.S. Pat. No. 4,954,673.

FIELD OF THE INVENTION

The present invention relates generally to a sensing edge for a door and, more particularly, to a redundant sensing edge for causing a closing door to open by actuating a device upon force being applied to the sensing edge.

BACKGROUND OF THE INVENTION

Employing pressure switches in sensing edges for doors is generally known. Such sensing edges generally include a sheath having several openings or chambers therein in fluid communication with each other to transmit therebetween pressure changes in response to the application of external pressure to the sheath. Other types of more conventional door edges include a pair of upper and lower flexible, electrically conductive sheets (e.g., aluminum foil) positioned on the upper and lower sides of a bridge. Upon application of pressure to the sheath, the conductive sheets are deflected into electrically conductive engagement with each other to thereby function as a switch to actuate suitable control circuitry for the door. Sensing edges with this type of construction may not be as sensitive as that contemplated by the present invention. For instance, before the control circuitry is actuated, the conductive sheets must travel the full distance therebetween to make an electrical connection. Moreover, forces which are applied to the sides of the sheath will not necessarily cause the electrically conductive sheets to deflect into engagement with each other to actuate the switch.

Generally, in sensing edges of this type, there is required a highly localized deflection to operate the switch. Even a substantial force or weight may not be sufficient to actuate such a switch if the force or weight is distributed over a substantial area. In an attempt to obviate this problem, such switches often include internal protrusions for locally enhancing internal forces reacting to an external weight. This structure adds to the cost of the materials, complexity of manufacture, and often inhibits or reduces flexibility and, therefore, requires additional space for shipping and storage.

Consequently, there exists a need for a sensing edge which will respond to forces applied anywhere along the surface of the sheath, including sideward acting forces.

There also exists a need for a switch which includes at least two independent sensing means to prevent failure of the switch in the event that one of the sensing means ceases operation.

The present invention is directed to a redundant sensing edge for causing a closing door to open by actuating a device upon force being applied to the sensing edge. The switch of the present invention is of relatively high profile and is sensitive to pressure being applied to any exposed surface of the surrounding sheath. In addition, the present invention overcomes the problems inherent in the conventional prior art sensing edges by incorporating a first substantially air-impervious chamber having a pressure switch therein for sensing pressure change within the chamber, and a second chamber incorporating two sheets of electrically conductive material with a layer of non-conductive material therebetween for providing additional sensing capability.

SUMMARY OF THE INVENTION

Briefly stated, the present invention comprises a redundant sensing edge for causing a closing door to open by actuating a device (not shown) upon force being applied to the sensing edge. The sensing edge comprises an elongate outer sheath compressible upon application of external pressure and fabricated of flexible air-impervious material. The sheath has a front surface, a back surface, a lower surface and an upper surface, the upper surface for being attached to a door edge. A substantially air-impervious sealed first chamber is within the elongate sheath proximate the lower surface of the sheath. A first pressure-sensitive switch having a switch element is in fluid communication with the first chamber for sensing pressure change within the first chamber, such that upon application of external pressure to the sheath, pressure within the first chamber is increased, and thereby communicated to the pressure switch for actuation thereof to thereby actuate the device. A second generally cylindrical chamber is positioned within the sheath for receiving a second switch. The second switch comprises a first generally cylindrical layer of resiliently compressible material having a first radially outer surface and a second radially inner surface. The first radially outer surface is in engagement with the second chamber. A first generally cylindrical layer of electrically conductive material having a first radially outer surface is in engagement with the second surface of the first layer of resiliently compressible material. The first layer of electrically conductive material further includes a second radially inner surface. The second switch further includes a generally cylindrical layer of non-conductive material having a first radially outer surface in engagement with the second surface of the first layer of electrically conductive material and a second radially inner surface. The layer of non-conductive material includes at least one opening extending therethrough between the first and second surfaces. A second generally cylindrical layer of electrically conductive material is provided having a first radially outer surface in engagement with the second surface of the layer of non-conductive material and a second radially inner surface. A second generally cylindrical layer of resiliently compressible material is provided having a first radially outer surface and a second radially inner surface. The first radially outer surface is in engagement with the second surface of the second layer of electrically conductive material. The second switch further includes a generally cylindrical support member having a radially outer surface. The support member is in engagement with the second surface of the second layer of resiliently compressible material The first and second layers of electrically conductive material are radially spaced apart by the layer of non-conductive material and present opposed portions to each other through the opening whereby upon the application of force to the sheath, the portion of at least one of the first and second layers of electrically conductive material deflects into the opening in the layer of non-conductive material and makes electrical contact between the first and second layers of electrically conductive material to thereby actuate the device.

BRIEF DESCRIPTION OF THE DRAWING

The foregoing Summary, as well as the following Detailed Description of the Preferred Embodiment, is better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DETAILED DESCRIPTION OF THE PREFERRED EMBODIMENT

Figure 1:
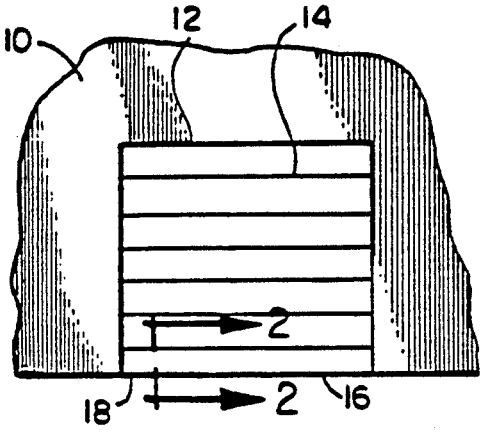
FIG. 1 is a elevational view showing a door construction including a sensing edge in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the redundant sensing edge and designated parts thereof. The terminology includes the words above specifically mentioned, derivatives thereof and words of similar import.

Figure 2:
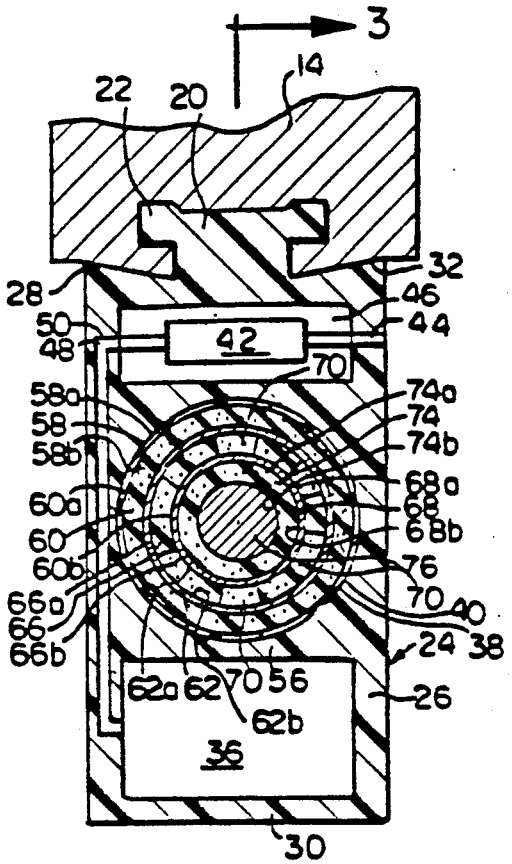
FIG. 2 is a greatly enlarged cross-sectional view of the sensing edge taken along line 2—2 of FIG. 1.
Figure 3:
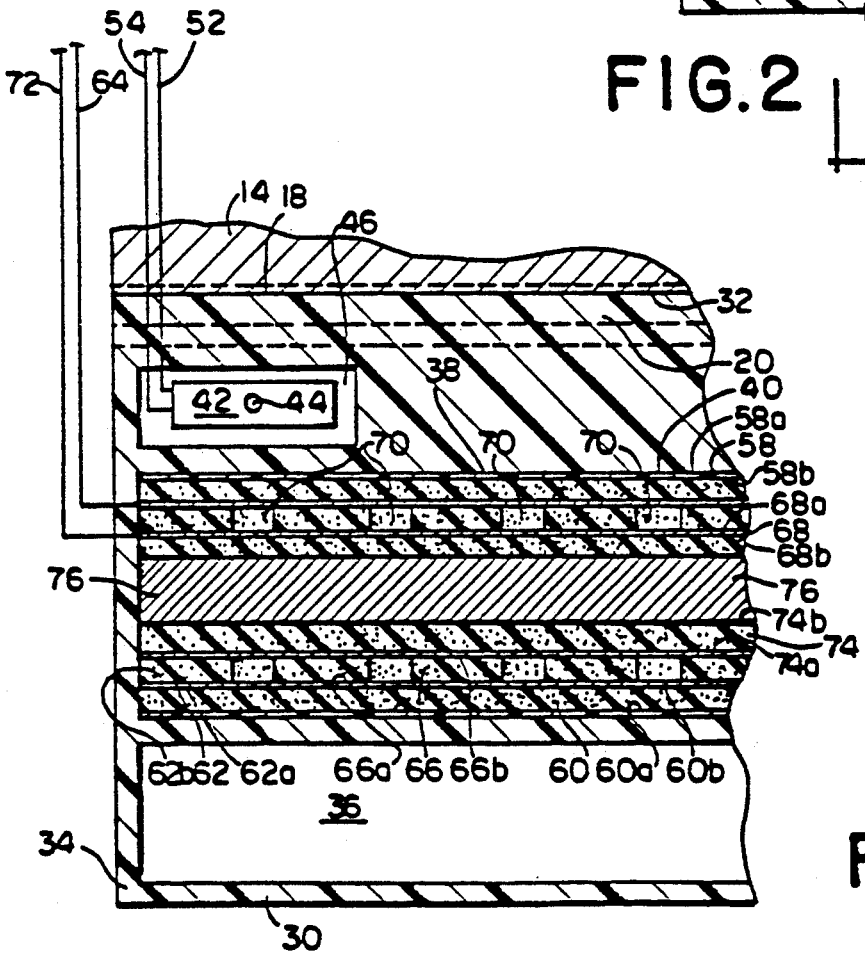
FIG. 3 is a cross-sectional view of the sensing edge taken along line 3—3 of FIG. 2.

Referring to the drawing in detail, wherein like numerals indicate like elements throughout, there is shown in FIGS. 1–3 a preferred embodiment of a redundant sensing edge in accordance with the present invention. There is shown in FIG. 1 a building wall 10 having a doorway 12 provided with a door 14. While the door 14, as illustrated, is an overhead door having a redundant sensing edge 16 in accordance with the present invention along its lower side or leading edge 18, it is within the spirit and scope of the invention to incorporate the sensing edge 16 described hereinafter along the edge of any door structure, such as vertically disposed or horizontally moveable doors (not shown) as desired. Moreover, it is understood by those skilled in the art that the redundant sensing edge 16 is not limited to use in connection with doors, but can be used for other applications, such as automatic windows.

Referring now to FIG. 2, the sensing edge 16 and the door 14 include securing means for affixing the sensing edge 16 to the leading edge 18 of the door 14. In the presently preferred embodiment, the securing means is comprised of a generally T-shaped member 20 on the sensing edge 16 positioned within a complementary T-shaped slot 22 in the lower surface of the door 14. Of course, the sensing edge 16 may be secured to the door 14 in any other suitable manner, for instance, with a traditional dovetail slot configuration (not shown). Moreover, it is also within the spirit and scope of the invention to secure the sensing edge 16 to the leading edge 18 of the door 14 by an adhesive (not shown) applied between the leading edge 18 and the peripheral face of the sensing edge 16.

Referring now to FIGS. 2 and 3, the sensing edge 16 is comprised of an elongate outer sheath 24 compressible upon application of external pressure and fabricated of flexible air-impervious material. The sheath 24 has a front surface 26, a back surface 28, lower surface 30, and an upper surface 32 including the T-shaped member 20 for engaging and being attached to the leading door edge 18. It is preferred that the sheath 24 have a generally constant cross-sectional outline configuration, extending closely along the entire leading edge 18 of the door 14. In the present embodiment, the sheath 24 is generally of rectangular cross section, but it may be of any other suitable shape, such as circular or semi-circular (not shown).

In the present embodiment, it is preferred that the sheath 24 be fabricated of a form-retaining, but flexible air-impervious material, such as rubber. The lower surface 30 of the sheath is for engagement with the door threshold or ground (see FIG. 1). The front and back surfaces 26 and 28 upstand integrally from opposite side edges of the lower surface 30. The upper surface 32 extends between the upper edges of the front and back surfaces 26 and 28 in close facing or complementary relation with the leading door edge 18. The T-shaped member 22 is formed with the sheath 24 along the upper surface 32 for releaseably interconnecting engagement with the leading door edge 18, thereby facilitating quick and easy mounting or removal and replacement of the sensing edge 16 with respect to the door 14. As shown in FIG. 3, end walls 34 (only one shown) close and seal the ends of the sheath 24.

A substantially air-impervious sealed first chamber 36 is generally rectangular in cross-section and is generally in the form of a parallelpiped. The first chamber 36 is preferably substantially air-tight. The first chamber 36 may be formed as part of the sheath 24 during the manufacturing process. While it is preferred that the first chamber be generally rectangular in cross-section, it is understood by those skilled in the art that other cross-sectional shapes and configurations, such as square, circular or oval (not shown) could be utilized.

Referring now to FIG. 3, the sensing edge 16 includes a second chamber 38 positioned within the sheath 24 for receiving a pressure-sensitive switch 40, described hereinafter. Protectively located between the door 14 and the second chamber 38 is a second pressure-sensing means. In the presently preferred embodiment, the second pressure-sensing means comprises a pressure-sensitive switch 42 having an air outlet 44 and a switch element in fluid communication with the first chamber 36, such that upon application of external pressure to the sheath 24, pressure within the first chamber 36 is increased and thereby communicated to the pressure switch 42 for actuation thereof to thereby actuate the door moving device It is preferred that the pressure-sensitive switch 42 be of the type in which electrical contact is either made or broken in response to sensed pressure changes. Switches of this type are well known in the art and are generally commercially available. For example, such pressure-sensitive switches are manufactured by Micropneumatic Logic, Inc. of Fort Lauderdale, Fla.

If desired, the pressure-sensitive switch 42 may be encased within protective material, such as foam (not shown) which may be installed within the generally open area 46 within the sheath 24 in which the pressure sensitive switch 42 is installed.

The pressure-sensitive switch 42 includes a pressure port or conduit 48 sealingly extending through an aperture 50 between the second chamber 38 and the back surface 28 of the sheath 24. The conduit 48 is inserted into the wall of the first chamber 36 to thereby communicate with the interior of the first chamber 36. It is understood by those skilled in the art that the conduit 48 may sealingly extend through an aperture 50 between the second chamber 38 and the front surface 26 of the sheath 24. The pressure-sensitive switch 42 is provided with electrical conductors or wires 52, 54 which extend outwardly in sealed relation from the sheath 24 for connection with desired control circuitry (not shown) for actuating the device in a manner well known in the art.

In the present embodiment, it is preferred that the first and second chambers 36, 38 be juxtapositioned within the sheath 24. More particularly, it is preferred that the second chamber 38 be positioned between the pressure-sensitive switch 42 and the first chamber 36, and that the pressure-sensitive switch 42 be positioned within the sheath 24 between the second chamber 38 and the upper sheath surface 32. However, it is understood by those skilled in the art that the pressure-sensitive switch 42, first chamber 36 and second chamber 38 can be positioned within the sheath in other manners with respect to each other, without departing from the spirit and scope of the invention. For example, the pressure-sensitive switch 42 could be positioned within the first chamber 36 or the second chamber 38.

In the present embodiment, it is preferred that the second chamber 38 have a generally circular configuration in cross section (FIG. 2), as compared to the generally parallelpiped configuration of the first chamber 36. However, it is understood by those skilled in the art that both the first and second chambers 36 and 38 may be of different shapes than those disclosed in FIG. 2, such as semi-circular or triangular and that the first and second chambers 36, 38 may be of the same or different shape with respect to each other.

Referring now to FIGS. 2 and 3, the first and second chambers 36, 38 are separated by an intermediate wall 56. A generally annular layer of flexible impermeable material 58 is positioned within the second chamber 38 and includes a first radially outer surface 58*a* and a second radially inner surface 58*b*. The first surface 58*a* of the flexible impermeable material layer 58 is in engagement or corresponding facing relationship with the intermediate wall 56 and the inner walls of the second chamber 38.

In the present embodiment, it is preferred that the flexible impermeable layer 58 is generally sized to complement the internal configuration of the second chamber 38. However, it is understood by those skilled in the art that the diameter of the flexible impermeable material layer 58 may be sized as small or as large as desired, and be of virtually any diameter for accommodating different structures and uses.

In the present embodiment, it is preferred that the flexible impermeable material layer 58 be advantageously fabricated of a form-retaining, but flexible air-impervious material, such as rubber. However, other materials may alternatively be employed.

Just inside (when viewing FIGS. 2 and 3) the flexible impermeable material layer 58 is a first generally cylindrical layer (annular in cross section) of resiliently compressible material 60, engaged therewith, and having a first radially outer surface 60*a* and a second radially inner surface 60*b*. The first surface 60*a* is in engagement or in corresponding facing relationship with the second surface 58*b* of the flexible impermeable material layer 58. In the present embodiment, it is preferred that the first layer of resiliently compressible material 60 be constructed of generally soft foam rubber. It is understood by those skilled in the art that the first layer of resiliently compressible material 60 can be constructed of either closed or opened cell foam rubber or of other materials having similar properties.

The first layer of resiliently compressible material 60 is in engagement with a first generally cylindrical layer (annular in cross section) of flexible, electrically conductive material 62 having a first radially outer surface 62*a* and a second radially inner surface 62*b*. The first surface 62*a* is in engagement or in corresponding facing relationship with the second surface 60*b* of the first layer of resiliently compressible material 60. In the present embodiment, it is preferred that the first layer of flexible, electrically conductive material 62 be generally thin and preferably be constructed of aluminum or aluminum foil. However, it is within the spirit and scope of the invention to construct the first layer of flexible, electrically conductive material 62 of other materials, such as copper, brass or an alloy thereof.

As shown in FIG. 3, an electrical conductor or wire 64 is electrically connected to the first layer of flexible, electrically conductive material 62, preferably by soldering at one end thereof. The electrical conductor 64 is used in connection with a circuit (not shown) for controlling the actuation of the device or door 14, as is understood by those skilled in the art, in response to the application of force to the sheath 24, as described hereinafter.

The first layer of flexible, electrically conductive material 62 is in engagement with a generally cylindrical layer (annular in cross section) of non-conductive material 66 having a first radially outer surface 66*a* and a second radially inner surface 66*b* for spacing apart the first layer of flexible, electrically conductive material 62 and a second layer of flexible, electrically conductive material 68. The first surface 66*a* is in engagement or corresponding facing relationship with the second surface 62*b* of the first layer of flexible, electrically conductive material 62.

The layer of non-conductive material 66 has at least one opening extending completely therethrough between the first and second surfaces 66*a*, 66*b* thereof. As shown in FIGS. 2 and 3, the layer of non-conductive material 66 preferably includes a plurality of openings 70 interspersed along it axial length and around its circumference for allowing the actuation of the switch 40 by applying pressure thereto, as described hereinafter.

In the present embodiment, it is preferred that the openings 70 be generally oval shaped in cross section. However, it is within the spirit and scope of the invention to configure the opening 70 of any geometric shape, such as square or circular.

The layer of non-conductive material 66 is preferably constructed of generally soft foam rubber. It is understood by those skilled in the art that the layer of non-conductive material 66 can be constructed of either closed or open cell foam rubber or other materials having similar properties, so long as the function of the switch 40 is achieved, as described hereinafter.

The layer of non-conductive material 66 is in engagement with a second generally cylindrical layer (annular in cross section) of flexible, electrically conductive material 68 having a first radially outer surface 68*a* and a second radially inner surface 68*b*. The first surface 68*a* is in engagement or corresponding facing relationship with the second surface 66*b* of the layer of non-conductive material 66.

In the present embodiment, it is preferred that the second layer of flexible, electrically conductive material 68 be constructed of the same material and configuration as the first layer of flexible, electrically conductive material 62. Similarly, the second layer of flexible, electrically conductive material 68 is connected to an electrical conductor or wire 72 for connection with a circuit for controlling the actuation of the door 14 or device in response to the application of force to the switch 42.

In engagement with the second layer of flexible, electrically conductive material 68 is a second generally cylindrical layer (annular in cross section) of resiliently compressible material 74 having a first radially outer surface 74*a* and a second radially inner surface 74*b*. The first surface 74*a* is in engagement or corresponding facing relationship with the second surface 68*b* of the second layer of flexible, electrically conductive material 68. The second layer of the resiliently compressible material layer 74 is preferably constructed of the same material of resiliently compressible material layer 60. However, it is apparent to those skilled in the art that the first and second layers of resiliently compressible material 60, 74 can differ in material.

The second surface 74*b* of the second layer of resiliently compressible material 74 is in engagement with a generally cylindrical (circular in cross section) support member 76. The support member 76 is generally solid and non-compressible and is located at the generally radial center of the switch 40. The resiliently compressible material layer 74 substantially completely surrounds the support member 76. The support member may be formed from any suitable, generally inflexible, incompressible material, for example, a suitable hardened plastic or metal.

As shown in FIG. 3, the first and second layers of flexible, electrically conductive material 62, 68 are spaced apart by the layer of non-conductive material 66 and present opposed portions to each other through the openings 70. Upon the application of force to the sheath 24, a portion of at least one of the first and second layers of flexible, electrically conductive material 62, 68 deflects into at least one of the openings 70 in the layer of non-conductive material 66, and makes electrical contact between the first and second layers of flexible, electrically conductive material 62, 68 actuating the pressure-sensitive switch 40 to thereby actuate the door control device.

In use, the sheath 24 is connected to the door 14 using the T-shaped member 20 as described above. The electrical conductors or wires 52, 54, 64 and 72 are connected to a circuit (not shown) for controlling the operation or actuation of a device (not shown) for controlling the actuation of the door 14 in response to the application of force to the sheath. Specifically, upon the application of force to the lower surface 30 of the sheath 24, pressure within the first chamber 36 is increased and communicated to the pressure switch 42 for actuation thereof to complete or break electrical contact and to thereby actuate the device.

In the presently preferred embodiment, application of force to the chamber 36 results in an increase in pressure in the pressure-sensitive switch 42. The increased pressure in the pressure-sensitive switch 42 forces the pressurized air in the pressure-sensitive switch 42 to escape through the air outlet 44, after the pressure increase actuates the switch 42. When the force is no longer applied to the chamber 36, the pressure in the pressure-sensitive switch 42 returns to ambient pressure via the exchange of air through outlet 44.

Similarly, upon the application of force to the front or back surfaces 26, 28, a portion of at least one of the first and second layers of flexible, electrically conductive material 62, 68 deflects into at least one of the openings 70 in the layer of non-conductive material 66 and makes electrical contact between the first and second layers of electrically conductive material to thereby complete or enable the circuit to actuate the device and control the actuation of the door 14.

Depending upon the magnitude of the force applied to the lower surface 30, how fast the magnitude of the force increases or decreases over time, and the properties of the materials in which the sheath 24 and pressure-sensitive switch 40 are constructed, it is understood by those skilled in the art that when such force is applied to the lower surface 30, either the pressure-sensitive switch 42 or the pressure-sensitive switch 40 may be actuated first. Moreover, in the event that either the pressure-sensitive switch 42 or the pressure-sensitive switch 40 fails, the remaining operating switch still serves to actuate the device, thereby providing the sensing edge 16 with redundancy.

From the foregoing description, it can be seen that the present invention comprises a redundant sensing edge for causing a closing door to open by actuating a device upon force being applied to the sensing edge. It is appreciated by those skilled in the art that changes could be made to the embodiment described above without departing from the broad inventive concepts thereof. It is understood, therefore, that this invention is not limited to the particular embodiment disclosed, but it is intended to cover all modifications which are within the scope and spirit of the invention as defined by the apended claims.

What to claim is:

1. A redundant sensing edge for causing a closing door to open by actuating a device upon force being applied to the sensing edge, the sensing edge comprising:

an elongate outer sheath compressible upon application of external pressure and fabricated of flexible air impervious material, the sheath having a front surface, a back surface, a lower surface and an upper surface, the upper surface for being attached to a door edge;

a substantially sealed air-impervious first chamber within the sheath proximate the lower surface of the elongate sheath;

a first pressure-sensitive switch having a switch element in fluid communication with the first chamber for sensing pressure change within the first chamber such that upon application of external pressure to the sheath, pressure within the first chamber is increased and thereby communicated to the pressure switch for actuation thereof to thereby actuate the device;

a second generally cylindrical chamber within the sheath for receiving a second switch, the second switch comprising:

a first generally cylindrical layer of resiliently compressible material having a first radially outer surface in engagement with the second chamber and a second radially inner surface;

a first generally cylindrical layer of electrically conductive material having a first radially outer surface in engagement with the second surface of the first layer of resiliently compressible material and having a second radially inner surface;

a generally cylindrical layer of non-conductive material having a first radially outer surface in engagement with the second surface of the first layer of electrically conductive material and a second radially inner surface, the layer of non-conductive material including at least one opening extending therethrough between the first and second surfaces;

a second generally cylindrical layer of electrically conductive material having a first radially outer surface in engagement with the second surface of the layer of non-conductive material and a second radially inner surface;

a second generally cylindrical layer of resiliently compressible material having a first radially outer surface in engagement with the second surface of the second layer of electrically conductive material and a second radially inner surface; and a generally cylindrical support member having a radially outer surface in engagement with the second surface of the second layer of resiliently compressible material, the first and second layers of electrically conductive material being radially spaced apart by the layer of non-conductive material and presenting opposed portions to each other through the opening whereby upon the application of force to the sheath, a portion of at least one of the first and second layers of electrically conductive material deflects into the opening in the layer of non-conductive material and makes electrical contact between the first and second layers of electrically conductive material to thereby actuate the device.

2. The sensing edge according to claim 1, wherein the first chamber and the second chamber are juxtapositioned within the sheath.

3. The sensing edge according to claim 1, wherein the sheath includes an intermediate wall for segregating the first and second chambers.

4. The sensing edge according to claim 3, further including a generally cylindrical layer of flexible impermeable material surrounding the first layer of compressible material and in engagement with the intermediate wall.

5. The sensing edge according to claim 1, wherein the pressure-sensitive switch is positioned within the sheath between the second chamber and the upper surface.

6. The sensing edge according to claim 1, wherein the air-impervious material is rubber.

7. The sensing edge according to claim 1, wherein the first and second layers of resiliently compressible material are foam rubber.

8. The sensing edge according to claim 1, wherein the first and second layers of electrically conductive material are sheets of aluminum.

9. The sensing edge according to claim 1, further including electrical conductors connected to each of the first and second layers of electrically conductive material for connection within a circuit for controlling the actuation of the door in response to the application of force to the lower surface of the sheath.

10. The sensing edge according to claim 1, wherein the second chamber is positioned between the pressure-sensitive switch and the first chamber.

* * * * *